United States Patent [19]

Sawada

[11] Patent Number: 4,772,767

[45] Date of Patent: Sep. 20, 1988

[54] WATERPROOF STRUCTURE OF SWITCH

[75] Inventor: Kenji Sawada, Furukawa, Japan

[73] Assignee: Alps Electric Co., Ltd., Tokyo, Japan

[21] Appl. No.: 48,451

[22] Filed: May 7, 1987

Related U.S. Application Data

[63] Continuation of Ser. No. 794,243, Nov. 1, 1985, abandoned.

[30] Foreign Application Priority Data

Nov. 1, 1984 [JP] Japan ..... 59-165991[U]

[51] Int. Cl.[4] ..... H01H 19/06

[52] U.S. Cl. ..... 200/302.3; 74/18.1

[58] Field of Search ..... 200/302.1-302.3, 200/339; 74/18.1; 277/30

[56] References Cited

U.S. PATENT DOCUMENTS

| | | | |
|---|---|---|---|
| 455,747 | 7/1891 | Goodridge | 200/302.3 |
| 1,493,413 | 5/1924 | Anderson | 200/302.3 |
| 2,666,829 | 1/1954 | Buckhard, Jr. et al. | 200/302.2 |
| 2,878,347 | 3/1959 | Schmidt | 200/302.3 |
| 3,858,012 | 12/1974 | Lockard | 200/302.3 |

FOREIGN PATENT DOCUMENTS

| | | | |
|---|---|---|---|
| 1299745 | 7/1969 | Fed. Rep. of Germany | 200/302.3 |
| 4455380 | 3/1980 | Japan . | |

*Primary Examiner*—Henry J. Recla
*Assistant Examiner*—Linda J. Sholl
*Attorney, Agent, or Firm*—Guy W. Shoup; Leighton K. Chong; Paul J. Winters

[57] ABSTRACT

The casisng of an electrical switch is made waterproof by a sliding seal interposed between a switch operating member located outside the casing and the peripheral edge of an opening into the casing. The operating member and seal engagingly slide on the peripheral edge of the casing and the operating member has a part which projects into the casing through a hole in the seal.

4 Claims, 4 Drawing Sheets

WATERPROOF STRUCTURE OF SWITCH

This is a continuation application from application Ser. No. 794,243 filed Nov. 1, 1985 now abandoned.

BACKGROUND OF THE INVENTION

This invention relates to a waterproof structure for a switch, and more particularly to a waterproof structure of an automobile switch for a power window or the like.

Conventionally, this type of switch is constructed by combining an operating member with a lever which projects from an opening at the top of a casing to form a seesaw type switch. The waterproof structure of such a switch is formed by covering it with an elastic material such as rubber to seal the opening in the casing, or by entirely covering the switch with a waterproof sheet.

However, this conventional waterproof structure is difficult to install, and high in cost. Further, the operating force for operating the switch is undesirably large by this technique because the elastic material must be plied to operate the switch.

SUMMARY OF THE INVENTION

It is an object of the present invention to eliminate the above-mentioned problems in the prior art.

It is another object of the present invention to provide a waterproof structure for a switch is simple in structure, easy to install, and low in cost.

It is further object of the present invention to provide a waterproof structure for a switch which may be operated with a light operating force and has a good operational feel.

According to the present invention, the waterproof structure of the switch comprises an elastic waterproof material slidably seated on the opening edge of a casing through which an operating member projects. The waterproof material is formed with a through-hole at a substantially central portion thereof, the through-hole being dimensioned to fit tightly around part of the operating member which projects into the casing.

Other objects and advantages of the invention will become apparent from the following description and accompanying drawing.

DETAILED DESCRIPTION OF THE PREFERRED EMBODIMENT

Figure 1:
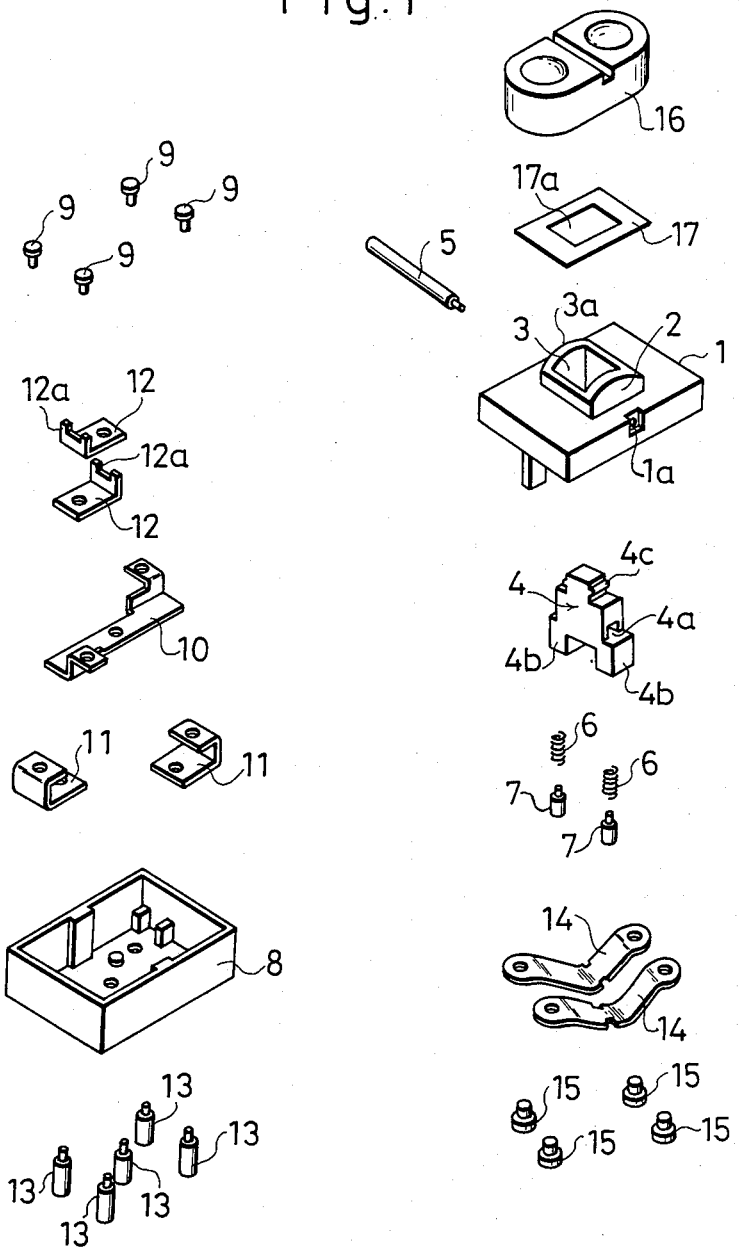
FIG. 1 is an exploded view in perspective of a switch in a preferred embodiment of the invention.
Figure 2:
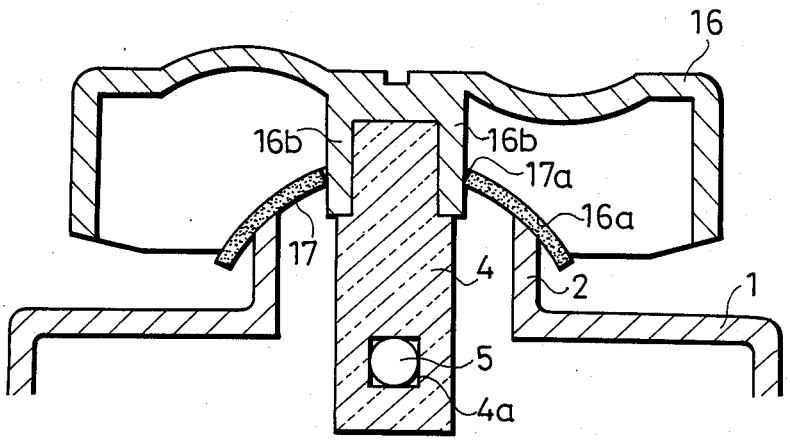
FIG. 2 is an elevational view in section of an essential part of the switch.
Figure 3:
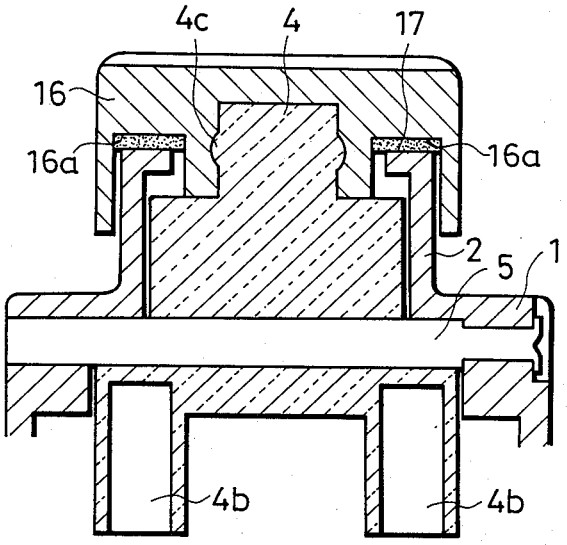
FIG. 3 is a side view in section of the essential part of the switch.

Referring to FIGS. 1 to 4, reference numeral 1 designates an upper case provided with a semicylindrical projected portion 2 on an upper surface thereof. The projected portion 2 is provided with an opening 3 on an upper surface thereof.

Reference numeral 4 designates a lever having a head portion projecting from the opening 3 of the upper case 1. The lever 4 is formed with a through-hole 4*a* at a substantially central portion thereof, into which a support shaft 5 is inserted, and the lever 4 is pivotally supported by the support shaft 5. That is to say, the lever 4 is retained in the upper case 1 by engaging one end of the support shaft 5 into a stopper hole 1*a* provided at a side surface of the upper case 1. The semicylindrical projected portion 2 preferably has a radius of curvature which matches the arc described by the lever 4 as it pivots about the shaft 5.

FIG. 1 illustrates assembly of the entire switch. The lever 4 is provided with a pair of drive member receiving portions 4*b* at a lower end thereof, and each of drive members 7 downwardly biased by coil springs 6 each of which is received in each of the drive member receiving portions 4*b*.

Reference numeral 8 designates a lower case adapted to be engaged with the upper case 1 to form a switch casing. Fixed to the lower case 8 are terminals 10 and 11 which are provided with fixed contact points 9. Central terminals 12 having conductor plate supporting portions 12*a* which are bent into an L-shape are fixed by caulking to a bottom surface of the lower case and they communicate out of the case by means of terminals 13.

Reference numerals 14 designate conductor plates supported by the conductor plate supporting portions 12*a* of the central terminals 12 and adapted to be pivoted by the drive members 7. The conductor plates 14 are formed in a V-shape, and are provided with contact points 15 at both ends of each.

The head portion of the lever 4 projecting from the opening 3 of the upper case 1 is combined with an operating member 16 for forming a seesaw type switch. Slidably seated on the peripheral edge 3*a* of the opening 3 of the upper case 1 is a sheet-like waterproof material 17 formed of elastic materials such as polyester having an outer peripheral edge of a size larger than an outside dimension of the peripheral edge 3*a*. The waterproof material 17 is interposed between the peripheral edge 3*a* and an abutting bottom surface 16*a* of the operating member 16 arcuately formed so as to be fitted to the peripheral edge 3*a*.

Combination of the head portion of the lever 4 with the operating member 16 is effected by engaging a projection 4*c* formed at the head portion of the lever 4 with a recess of a receptacle portion 16*b* provided on a lower surface of the operating member 16. The waterproof material 17 is formed with a through-hole 17*a* at a substantially central portion thereof which through-hole 17*a* has a peripheral edge tightly contacting with an outer peripheral surface of the receptacle portion 16*b* of the operating member 16. Further, a grease such as silicone having viscosity is applied on the peripheral edge 3*a* of the upper case 1, to enhance sealing and provide lubrication.

Figure 4:
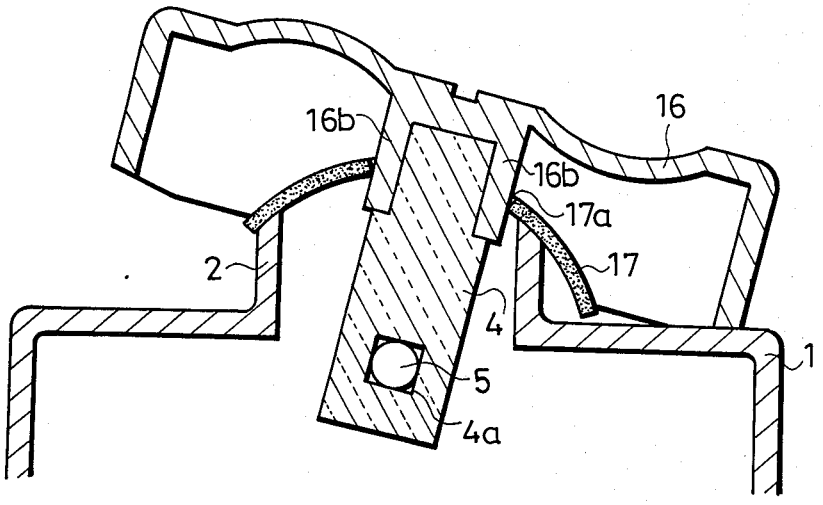
FIG. 4 is an elevational view in section similar to FIG. 2, with an operating member inclined.

According to the waterproof structure in the present invention, when the operating member 16 is operated into an inclined position as shown in FIG. 4, the waterproof material 17 slides in association with the motion of the operating member 16. Accordingly, the waterproof structure does not increase the operational torque or change the operational feeling.

Further, the waterproof sheet 17 may be easily installed onto the operating member 16 by disposing the waterproof material 17 on the head portion of the lever 4 and pressfitting the receptacle portion 16*b* of the operating member 16 to the head portion of the lever 4.

Furthermore, since the size of the waterproof material 17 is larger than the outside dimension of the opening edge 3*a* of the upper case 1, it does not allow formation of a clearance when the operating member 16 is inclined and the waterproof material 17 slides on the peripheral edge *3a*.

Having thus described the preferred embodiment of the invention, it should be understood that numerous structural modifications and adaptations may be restored to without departing from the spirit of the invention.

What is claimed is:

1. A waterproof structure of a switch comprising:

a casing having an upper projected portion ending in a peripheral edge having an arcuate upper surface curving along one pivoting direction and encircling an opening therethrough;

a pivotable, operating member extending in at least said one direction and defining a hollow interior, open through a lower receptacle portion thereof for receiving said projected portion of said casing in said hollow interior and thereby extending over and covering said opening of said projected portion, and said receptacle portion having an arcuate lower surface recessed in the interior of said operating member which faces in contact with and arcuately slides on said arcuate upper surface of said peripheral edge when said operating member is pivotably moved, said operating member mounting an operating lever which extends from the lower portion thereof through said opening of said projected portion into said casing; and a sheet of flexible, waterproof material having a peripheral portion encircling an opening which is shaped similarly to the opening in said peripheral edge of said projected portion of said casing, and which is clamped tightly yet slidingly by said arcuate recessed lower surface in said receptacle portion of said operating member on said arcuate upper surface of said peripheral edge of said projected portion, thereby forming a sliding, sealing surface on which the operating member slides pivotably upon said projected portion of said casing with said operating lever extending into said casing.

2. A waterproof structure of a switch according to claim 1, wherein said waterproof sheet is installed in said operating member so as to move in said one pivoting direction therewith, and has a dimension larger than said projected portion in said one pivoting direction so as to ensure that said opening remains sealed by said waterproof sheet over a range of pivoting movement of said operating member.

3. The waterproof structure of the switch as defined in claim 1, wherein a viscous material is applied on said opening edge of said casing, so as to enhance sealability.

4. The waterproof structure of the switch as defined in claim 3, wherein said viscous material is a grease such as silicone.

* * * * *

UNITED STATES PATENT AND TRADEMARK OFFICE

CERTIFICATE OF CORRECTION

PATENT NO. : 4,772,767

DATED : September 20, 1988

INVENTOR(S) : Kenji Sawada

It is certified that error appears in the above-identified patent and that said Letters Patent is hereby corrected as shown below:

Title page:

Abstract, line 1 "casisng" should be --casing--.

Signed and Sealed this

Twenty-first Day of March, 1989

*Attest:*

DONALD J. QUIGG

*Attesting Officer*

*Commissioner of Patents and Trademarks*